United States Patent [19]

Morgenstern et al.

[11] Patent Number: 4,764,318

[45] Date of Patent: Aug. 16, 1988

[54] PROCESS FOR THE CONTINUOUS COKING OF PITCHES AND UTILIZATION OF THE COKE OBTAINED THEREBY

[75] Inventors: Manfred Morgenstern; Claus Bertrand, both of Castrop-Rauxel, Fed. Rep. of Germany

[73] Assignee: Ruetgerswerke Aktiengesellschaft, Frankfurt, Fed. Rep. of Germany

[21] Appl. No.: 23,052

[22] Filed: Mar. 6, 1987

[30] Foreign Application Priority Data

Mar. 20, 1986 [DE] Fed. Rep. of Germany ..... 3609348

[51] Int. Cl.[4] ..... B29C 71/02

[52] U.S. Cl. ..... 264/29.5; 201/6; 201/17; 201/25; 208/22; 264/29.7; 264/105; 264/118; 264/125

[58] Field of Search ..... 264/29.1, 29.5–29.7, 264/105, 118, 125; 201/6, 25, 17; 208/22

[56] References Cited

U.S. PATENT DOCUMENTS

| | | | |
|---|---|---|---|
| 3,316,183 | 4/1967 | King et al. | 264/105 |
| 3,700,564 | 10/1972 | Willibald et al. | 201/6 |
| 3,756,791 | 9/1973 | Mancke | 201/17 |
| 4,053,365 | 10/1977 | Welter | 201/25 |
| 4,197,160 | 4/1980 | Degrave et al. | 201/6 |
| 4,218,288 | 8/1980 | Theodore | 201/6 |
| 4,233,117 | 11/1980 | Jüntgen et al. | 264/29.6 |
| 4,303,477 | 12/1981 | Schmidt et al. | 201/17 |
| 4,334,960 | 6/1982 | Brandenberger et al. | 264/29.7 |
| 4,369,171 | 1/1983 | Grindstaff et al. | 264/29.1 |
| 4,534,949 | 8/1985 | Glaser et al. | 264/29.5 |

FOREIGN PATENT DOCUMENTS

| | | | |
|---|---|---|---|
| 0158387 | 10/1985 | European Pat. Off. | 201/17 |
| 2925202 | 1/1981 | Fed. Rep. of Germany | 201/25 |

*Primary Examiner*—Jeffery Thurlow

*Attorney, Agent, or Firm*—Beveridge, DeGrandi & Weilacher

[57] ABSTRACT

Coke for reactor graphite is produced continuously by coking a hard pitch with a softening point (K.-S.) above 130° C. and a coking residue of at least 45% by weight in a rotary pipe furnace equipped with a moving device and subsequent calcination without intermediate cooling. The temperature of the inner wall of the indirectly heated furnace ranges from about 500° to about 800° C. The gases and vapors formed during the coking process are guided in countercurrent flow to the pitch.

12 Claims, 3 Drawing Sheets

Figure 1:
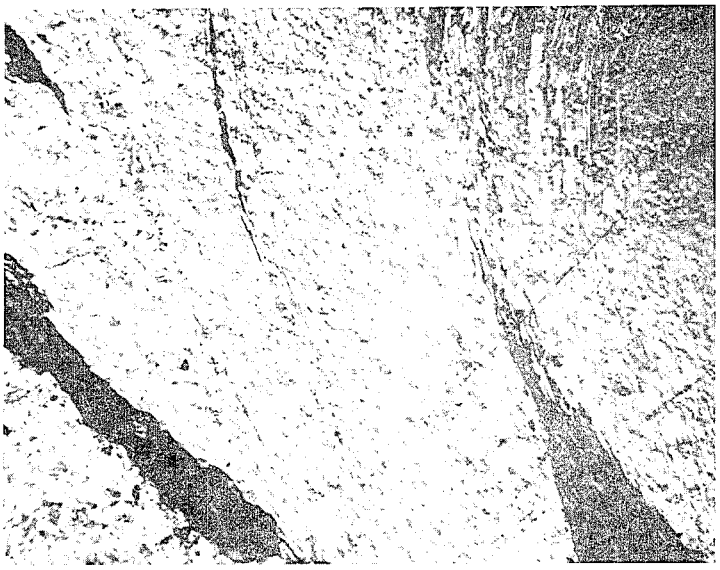

PROCESS FOR THE CONTINUOUS COKING OF PITCHES AND UTILIZATION OF THE COKE OBTAINED THEREBY

The present invention relates to a process for the continuous coking of pitches, particularly of bituminous coal tar hard pitches, and the use of the resulting coke obtained according to this process. In a further aspect, the present invention pertains to products obtained thereby.

At the present time, three different coking processes are generally employed for the coking of high boiling residues derived from bituminous coal tar or derived from petroleum oil; namely:

(a) the horizontal chamber-coking process (b) the delayed coking process and (c) the fluid-coking process.

The process according to a) is a high temperature coking and apart from some peculiarities corresponds to the known coal coking process. As the initial starting material, there is employed a bituminous coal tar hard pitch with a coking residue according to Brockmann-Muck of more than 50%. The coke obtained is very hard and generally need not be calcined because of the high coking temperature of at least 1000° C. The process is very labor intensive The equipment installations used in this known process, particularly the furnace lining, are more subject to repair than is the case when using coal for coking because of the physical and chemical characteristics of the hard pitch as compared to those of the coal. The process itself is discontinuous so that a multiplicity of chambers is required in order to approach a quasi-continuous operation.

The process according to b) is a low temperature carbonization process carried out at about 500° C. As the initial starting material, bituminous coal tar soft pitches as well as residues of the petroleum oil industry can be used. Originally, a delayed coker was operated as a thermal cracker. However, it was soon recognized that it is an excellent apparatus for the production of highly anisotropic special cokes. The low temperature coke obtained must be dried and calcined to permit its further use. The costs of the equipment are high so that profitability of the operation is possible only in the case of the production of particularly high value cokes or valuable oils. In the case of untreated bituminous coal tar pitches, this is normally not the situation. The process may be carried out in a quasi-continuous manner with at least two coker drums.

The process according to c) is likewise a low temperature carbonization process which, however, is carried out continuously. The fluid coker is a thermal cracker for petroleum oil residues. The coke that is formed as a residual product from this process is used as a fuel. For bituminous coal tar pitches, this process is less suitable because of the very low yield in oil and gas. Accordingly, it is an object of the present invention to provide an improved process for the coking of bituminous coal tar hard pitches and comparable products, and to provide suitable areas of application for the coke produced in accordance therewith.

In carrying out the process of the invention, one feature resides in coking the hard pitch in an externally heated, rotary pipe furnace at temperatures of the inside wall between 500° and 850° C. and with a dwell time of 0.5 to 1.5 hours. The gases and vapors are formed as a result thereof are guided in countercurrent stream to the flow of pitch that is being coked. The low temperature coke obtained thereby is calcined subsequently in the conventional manner, preferably without previous cooling. The furnace is fitted with a device that moves the solid substances through the furnace apparatus.

Suitable for use as the hard pitch are aromatic residues with a softening point according to KraemerSarnow (K.-S.) of at least 130° C. and a coking residue according to Brockmann-Muck (B.-M.) of at least 45% by weight. These starting materials can be derived from hard coal, such as for example bituminous coal tar hard pitch, or from petroleum oil such as for example petrohard pitch from the benzene pyrolysis for the production of olefines. These starting materials are known in the art and are readily obtainable.

For purposes of improved efficiency, the rotary pipe furnace should be subdivided into several variably heatable sections. By using outside heating means for the furnace, the forward sections of the furnace at and near starting material inlet port are heated to an outside temperature of about 850° C. The outside temperature of the succeeding sections of the furnace can then drop to about 600° C. Such furnaces and screw conveyor are well known in the art for other purposes, such as for pyrolysis processes for solid wastes.

In order to avoid an absorption of the condensates on the low temperature coke, the gases and vapors are streamed in countercurrent flow to the pitch that is to be coked. After leaving the rotary pipe furnace at the inlet end, the vapors are condensed and may be used as carbon black oil components or may be used for the production of the hard pitch. It has been found to be beneficial to inject an inert gas in the discharge end of the rotary pipe furnace. The dwell time of the vapors in the coking zone will be shortened as a result and the formation of carbon black and the deposits in the downstream vapor lines will be avoided.

A worm conveyor device suitable for being loaded with particulate material and conically shaped in the direction of the starting material feed inlet, located in the front part of the furnace has proven itself to be suitable as a moving device. The worm device is at least approximately $\frac{1}{3}$, preferably $\frac{1}{2}$ as long as the rotary pipe and the inclination of which is greater than that of the rotary pipe. A smooth roller conveyor can be connected downstream from the worm device. Preferably, self-centering, the worm conveyor device is moved by a drum in a power driven manner.

The pitch may be fed in solid pieces, for example by way of a rotary sluice, or in liquid form into the rotary pipe furnace. At the end of the furnace, the low temperature coke is discharged in piece form by way of an additional rotary sluice and can be fed directly to the calcining apparatus. Calcining means subjecting a material to heating at very high temperatures. Since the cooling off of the coke with water as is the case when following coking processes a) and b) is omitted by the present invention, considerably less time and energy is required for the calcination. The calciner apparatus is conventional and can be directly fired. The flue gas obtained therefrom can be recycled for injection at the discharge end of the coking furnace.

As is well known, rotary pipe furnaces have been employed for the coking or calcining of solid fuels such as low temperature coke and lignite or for the pyrolysis of predominantly solid wastes. However, in these conventional processes, a coking of the initial starting products at the hot wall of the furnace is not to be expected, or may occur only to a slight extent.

The invention is further illustrated by the drawings, wherein

Figure 2:
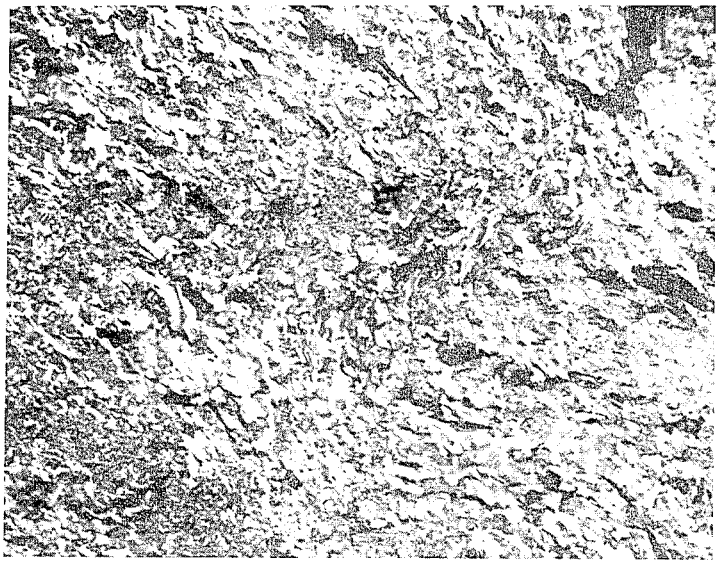
Figure 3:
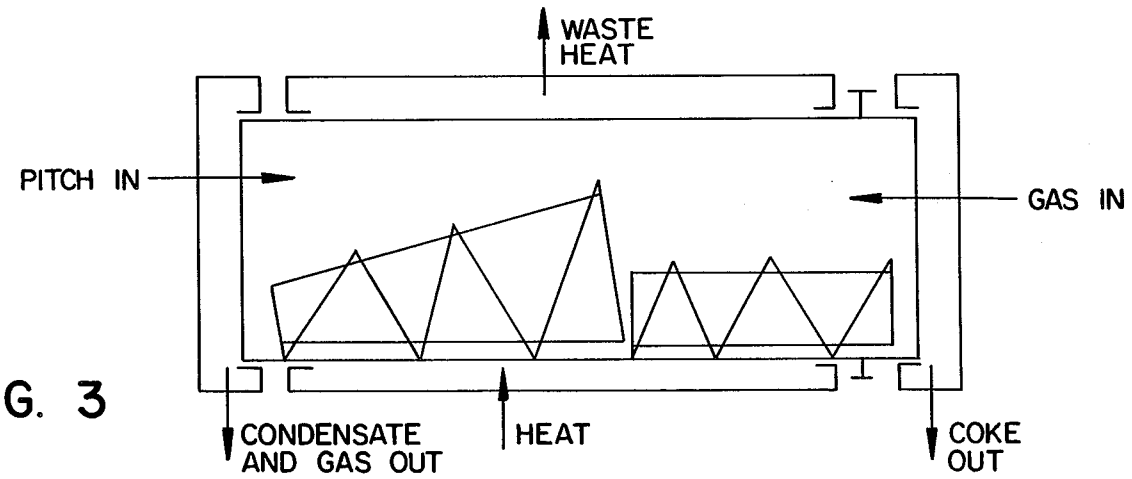

FIG. 1 is an optical micrograph of a polished surface of pitch coke obtained from a horizontal chamber furnace, FIG. 2 is an optical micrograph of a polished surface of pitch coke obtained in accordance with the invention, and FIG. 3 is a diagram of the furnace used in accordance with the invention.

It is accordingly a feature of the present invention to provide a process for the continuous coking of pitches wherein a hard pitch, such as one having a softening point (K-S) of at least 130° C. and a coking residue (B-M) of at least 45% by weight, is introduced to a rotary heating zone wherein the pitch is subjected to coking temperatures in the range of about 500° C. to about 800° C. for a time of 0.5 to 1.5 hours, during which dwell time the coke travels through the longitudinal length of the heating zone by suitable moving means. During the dwell time gases and vapors will generally evolve from the pitch undergoing the coking process and these gases are led in a countercurrent flow manner through the heating zone. This can be accomplished for example by the injection of inert gas, such as nitrogen, at the discharge end of the heating zone.

It is a further feature of the present invention to provide for a process as described wherein the coked pitch is immediately subjected to calcining temperatures without any cooling off or intermediate storage.

Still further, it is a feature of the invention to provide a process for making reactor graphite by grinding the coked pitch obtained as described to a size such that the particles are at most about 0.5 mm and mixing the finely divided solid coked pitch with a conventional binder such as standard electrode pitch. Thereafter, the resulting mass is pressed under conventional conditions into the desired electrode shapes; e.g. round, square, etc. of the desired size. Calcining is then carried out at temperatures of at least 900° C. Thereafter, the electrodes are subjected to conventional graphitizing processes to obtain the superior reactor electrode of the invention.

The detailed description of the invention will be explained with reference to the following examples.

EXAMPLE 1

Into a rotary pipe furnace having an inside diameter of 0.8 m and a heated length of 7.2 m and equipped with a 4 m long conical worm device in the forward portion of the furnace, there is charged 75 kg/h of a bituminous coal tar hard pitch with a softening point (K.-S.) of 150° C. and a coking residue (B.-M.) of 50%. The furnace is subdivided into 6 sections, each of which is heated indirectly with gas. The temperature of the outside wall in the area of the input opening is about 850° C. and drops to 700° C. at the discharge end. The mean temperature over the length of the individual heating zones; i.e. the outside temperature of the pipe wall, is approximately 800° C. The rotary pipe is driven at 2 rpm. The mean dwell time of the coking pitch in the rotary pipe furnace is approximately 1.5 hours. The furnace exhibits no baking on or caking of any kind and the green coke is obtained in the form of pieces (74% by weight larger than 5 mm, 99% by weight larger than 1 mm). The coke has a high density and strength It is fed into a calcining drum without cooling off or intermediate storage and is calcined there at 1300° C. in the conventional manner.

EXAMPLE 2

Example 1 is repeated with a throughput of 300 kg/h of pitch at a revolving rate of 6 rpm. The dwell time of the coking pitch in the rotary pipe furnace is thereby reduced to about 0.5 hour. There is obtained 71% by weight of green coke with 3.5% of weight of volatile matter and a bulk density of 0.5 g/cm$^3$, 11% by weight of heavy oil, 14% by weight of light oil and 4% by weight of gas and losses. During the coking, the rotary pipe furnace is flushed with 30 m$^3$/h of nitrogen in countercurrent flow to the pitch. Gases and vapors leave the furnace at the pitch charging port and are condensed in two steps. The green coke is transferred immediately into a conventional calcining drum and is calcined there at 1300° C. There is obtained 89% by weight of calcined coke with a residual hydrogen content of 0.1% by weight and a true density of 2 028 g/cm$^3$.

In the examples, a conical screw with an inclination of 1.35% was used, wherein the smaller diameter of the cone is oriented towards the inlet end of the rotary kiln coking furnace with an inclination of 0.5%. The device is driven by friction forces.

The analyses of the oils and of the gas obtained in the process are set forth in Tables I and II.

In Table III, the calcined coke (1) obtained according to the invention is compared in its characteristics with standard petro-coke (2) and with pitch coke obtained from a horizontal chamber furnace (3). The comparisons are carried out in the conventional manner using molded bodies.

TABLE I

| Analyses of the condensate | Heavy Oil | Medium Oil |
|---|---|---|
| Density at 120° C. (g/cm$^3$) | 1.21 | 1.15 |
| S.p. (K.-S.) (°C.) | 48 | — |
| QI (%) | 5.4 | 3.0 |
| TI (%) | 6.4 | 3.7 |
| Coking residue (B.-M.) (%) | 13.3 | 7.1 |
| Ash (%) | 0.1 | 0.03 |
| C (%) | 91.6 | 92.4 |
| H (%) | 5.1 | 5.2 |
| N (%) | 1.21 | 1.11 |
| S (%) | 0.7 | 0.74 |
| Boiling analysis (°C.) | | |
| Beginning | 344 | 264 |
| 10% | 410 | 302 |
| 20% | 444 | 320 |
| 30% | 465 | 350 |
| 34% | 475 | 379 |
| 40% | | 429 |
| 50% | | 455 |
| 60% | | 460 |
| Residue: S.p. (K.-S.) (°C.) | 130 | 128 |

TABLE II

| Gas analysis (inclusive of the introduced nitrogen) | |
|---|---|
| Gas analysis | (vol %) |
| $O_2$ | 1.3 |
| $N_2$ | 27.0 |
| CO | 0.9 |
| $CO_2$ | 0.5 |
| $H_2$ | 54.4 |
| $CH_4$ | 12.3 |
| $C_2H_4$ | 0.4 |
| $C_2H_6$ | 0.8 |
| $C_3H_8$ | 1.0 |
| $H_2S$ | 0.25 |

TABLE III

| Type of coke | Coke investigations: $CO_2$-consumption ($mg/cm^2h$) | electric conductivity (S/cm) longitudinally | electric conductivity (S/cm) transversely |
|---|---|---|---|
| 1 | 120 | 154 | 130 |
| 2 | 110 | 140 | 117 |
| 3 | 154 | 142 | 111 |

| | Graphite acc. to the invention | gilsonite graphite |
|---|---|---|
| true density | 2.18 | 2.16–2.19 |
| thermal expansion coefficient (20–1000° C.) | | |
| $\alpha\perp 10^{-6} K^{-1}$ | 5.22 | 5.30–6.25 |
| $\alpha \parallel 10^{-6} K^{-1}$ | 4.72 | 4.85–6.00 |
| $\alpha\perp/\alpha \parallel$ | 1.11 | 1.09–1.4 |

The coke obtained in accordance with the process of the invention is distinguished by low $CO_2$ consumption and high electric conductivity. As compared to the conventional pitch coke, the coke of the invention, despite its higher conductivity, is finer in structure and even has a mosaic like appearance, as the smooth surface photo micrographs show in comparison.

The advantages of the coking process according to the invention include a short coking time of 1.5 to 0.5 hours, a reduced capital equipment need and the easy servicing. In addition, it is possible to recycle the fines portions of the coke and to coke it together with the starting material pitch.

Because of its evenly mosaic-like structure, the coke produced according to the process of the invention appears to be suitable for the production of reactor graphite. It has been known that for this purpose, cokes with a low anisotropic coefficient are especially suitable. For this purpose, 100 parts by weight of the coke produced according to the invention are ground to a grain size of at most 0.5 mm and are mixed with 27.5 parts by weight of a standard electrode or binder pitch. This mass is pressed into test electrodes and calcined at 900° C. The electrode binder pitch is a conventional substance and customarily used for the production of shaped carbon bodies from coke. The process of pressing into electrodes is a conventional technique. From the test electrodes, small bars are cut which are then calcined at 1300° C. These bars have a true density of 2.12 $g/cm^3$ and a thermal expansion coefficient ($\alpha$) in longitudinal and transverse direction in the range of 20 to 200° C. of $$\alpha_{\parallel}=4.6\times10^{-6}/K$$

$$\alpha_{\perp}=5.1\times10^{-6}/K.$$

From this, an anisotropic coefficient of $\alpha\perp/\alpha_{\parallel}$ of 1.11 can be calculated.

The small bars are graphitized at 2700° C. in accordance with conventional methods and their physical characteristics are compared with those of a reactor graphite made of gilsonite coke.

In general, the reactor graphite products can be made with a circular cross-section with a diameter of, for example, between 62 and 500 mm. Alternatively, the cross-section can be square, for example, 100×100 to 350×350 mm. The length of the rod can vary, for example, up to 2500 mm. The shape can also be brick-like, up to 600×800×2500 mm.

A typical formulation of the reactor product is 70 to 84 parts of ground calcined coke and 16 to 30 parts of binder pitch. This is then mixed at any convenient temperature above the melting point of the pitch and is shaped into the desired form. The shaped bodies are then heated to about 900° C. and afterwards are graphitized.

As the analyses data show, the coke produced according to the invention is eminently well suited for the manufacture of reactor graphite. For pitch coke made of standard, not purified hard pitch it has an unusually low expansion coefficient and a low anisotropic coefficient. A further advantage is its low pore volume.

Further variations and modifications of the present invention will be apparent to those skilled in the art from the foregoing and are intended to be encompassed by the claims appended hereto.

We claim:

1. A process for the continuous coking of pitches, comprising subjecting a hard pitch which has a softening point (Kraemer-Sarnow) of at last 130° C. and a coking residue (Brockmann-Muck) of at least 45% by weight, to coking temperature in a rotary heating zone, said rotating heating zone being a rotary kiln or rotary pipe furnance fitted with a device that moves material through the furnace, which is a worn conveyor device conically shaped with its smaller diameter in the direction of the starting material feed inlet located at the front part of the furnace, wherein the inclination of the device is greater than the inclination of the furnace, said zone being heatable from the outside such that the temperatures of the heating zone are between about 500° and about 800° C., and said pitch being in said zone for a dwell time of 0.5 to 1.5 hours, whereby the gases and vapors formed at the coking temperature are guided in countercurrent flow to the pitch that is being coked, said hard pitch being moved through said zone at an even rate to the discharge end to recover a coked pitch which is anisotropic and has an evenly mosaic-like appearance or structure.

2. The process as in claim 1, wherein an inert gas is fed in at the discharge end of the rotary heating zone.

3. The process as in claim 1, further comprising calcining the coked pitch without any cooling.

4. The process as in claim 1, further comprising collecting the said gases and vapors and condensing said gases and vapors.

5. The process as in claim 1, wherein the hard pitch is in solid pieces.

6. The process as in claim 1, wherein the pitch is liquid.

7. A process for making a reactor electrode comprising subjecting a hard pitch which has a softening point (Kraemer-Sarnow) of at least 130° C. and a coking residue (Brockmann-Muck) of at least 45% by weight, to coking temperature in a rotary heating zone, said rotary heating zone being a rotary kiln or rotary pipe furnace fitted with a device that moves mateial through the furnace, which is a worm conveyor device conically shaped with its smaller diameter in the direction of the starting material feed inlet located at the front part of the furnaace, wherein the inclination of the device is greater than the inclination of the furnace, said zone being heatable from the outside such that the temperature of the heating zone is between about 500° C. and 800° C., said pitch being in said zone for a dwell time of 0.5 to 1.5 hours, guiding the gases and vapors formed in said heating zones in countercurrent flow to the pitch, said pitch being moved through said zone at an even rate to the discharge end of said zone to recover a coked pitch, grinding the coked pitch to finely divided particulates mixing said coked pitch particulates with a suitable binder and shaping into the desired shape, calcining said shape at elevated temperature to obtain an electrode and graphitizing said electrode which has a mosaic-like structure and a low anisotropic coefficient.

8. The process as in claim 7, wherein prior to grinding the coked pitch is first calcined.

9. The process as in claim 7, wherein the coked pitch is ground to a size no larger than 0.5 mm.

10. The process as in claim 7, wherein the binder is standard electrical pitch.

11. The process as in claim 7, wherein the coked pitch and binder are shaped into a rod or bar.

12. The process as in claim 7, wherein the calcining is conducted at a temperature of at least 900° C.

* * * * *